US009459076B2

(12) United States Patent
McHale et al.

(10) Patent No.: US 9,459,076 B2
(45) Date of Patent: Oct. 4, 2016

(54) RIFLE SCOPE, APPARATUS, AND METHOD INCLUDING PROXIMITY DETECTION AND WARNING SYSTEM

(71) Applicant: TrackingPoint, Inc., Austin, TX (US)

(72) Inventors: John Francis McHale, Austin, TX (US); John Hancock Lupher, Austin, TX (US)

(73) Assignee: TrackingPoint, Inc., Pflugerville, TX (US)

( * ) Notice: Subject to any disclaimer, the term of this patent is extended or adjusted under 35 U.S.C. 154(b) by 0 days.

(21) Appl. No.: 13/712,924

(22) Filed: Dec. 12, 2012

(65) Prior Publication Data

US 2014/0157646 A1 Jun. 12, 2014

(51) Int. Cl.
*F41G 1/38* (2006.01)
*F41A 17/08* (2006.01)

(52) U.S. Cl.
CPC *F41G 1/38* (2013.01); *F41A 17/08* (2013.01)

(58) Field of Classification Search
CPC ..... F41G 3/06; F41G 3/08; F41G 1/38; F41G 1/473; G02B 23/14
USPC ..... 89/111–148
See application file for complete search history.

(56) References Cited

U.S. PATENT DOCUMENTS 5,307,053 A * 4/1994 Wills et al. ..... 340/573.1
5,786,772 A * 7/1998 Schofield et al. ..... 340/903
5,929,786 A * 7/1999 Schofield et al. ..... 340/903
6,198,409 B1 * 3/2001 Schofield et al. ..... 340/903
6,449,892 B1 * 9/2002 Jenkins ..... 42/1.01
7,518,713 B2 * 4/2009 Ash ..... 356/141.5
7,656,312 B2 2/2010 Fellenstein et al.
7,898,395 B2 * 3/2011 Green ..... 340/384.7
8,474,172 B2 * 7/2013 Ivtsenkov et al. ..... 42/106
2006/0082730 A1 4/2006 Franks
2006/0190724 A1 * 8/2006 Adams et al. ..... 713/166
2007/0103671 A1 * 5/2007 Ash ..... 356/139.01
2007/0103673 A1 * 5/2007 Ash ..... 356/141.5
2009/0056153 A1 3/2009 Tippett et al.
2009/0091459 A1 * 4/2009 Stumpf et al. ..... 340/573.1
2009/0171559 A1 * 7/2009 Lehtiniemi et al. ..... 701/201
2009/0320348 A1 * 12/2009 Kelly ..... 42/119
2010/0027545 A1 2/2010 Gomes et al.
2011/0137995 A1 * 6/2011 Stewart ..... 709/205
2011/0199393 A1 * 8/2011 Nurse et al. ..... 345/665
2012/0106170 A1 * 5/2012 Matthews et al. ..... 362/311.06
2012/0158281 A1 * 6/2012 Lehtiniemi et al. ..... 701/400
2012/0159833 A1 * 6/2012 Hakanson et al. ..... 42/131
2012/0176525 A1 * 7/2012 Garin et al. ..... 348/333.02
2013/0316821 A1 * 11/2013 Summons et al. ..... 463/31
2014/0109458 A1 * 4/2014 Maryfield et al. ..... 42/119
2014/0110482 A1 * 4/2014 Bay ..... 235/404
2014/0115942 A1 * 5/2014 Plaster ..... 42/126

* cited by examiner

*Primary Examiner* — Joshua Freeman

(74) *Attorney, Agent, or Firm* — Cesari & Reed LLP; R. Michael Reed

(57) ABSTRACT

A method of providing proximity detection includes receiving a signal at a rifle scope indicating proximity of a second rifle scope. The method further includes providing a visual alert to a display of the rifle scope based on the proximity.

22 Claims, 3 Drawing Sheets

RIFLE SCOPE, APPARATUS, AND METHOD INCLUDING PROXIMITY DETECTION AND WARNING SYSTEM

FIELD

The present disclosure is generally related to rifle scopes, and more particularly to rifle scopes including proximity detection.

BACKGROUND

When multiple hunters are in relatively close proximity, there is always the potential for a gun being fired in the direction of another hunter because the shooter didn't know the other hunter was there, which ultimately can result in an accidental shooting. Furthermore, for safety and security, it is desirable for a hunter to be aware of other hunters in the area, even if they are not in the same hunting party. Unfortunately, conventional firearms do not provide proximity detection.

SUMMARY

In an embodiment, a rifle scope includes a receiver configured to receive a signal and a controller coupled to the receiver. The controller is configured to determine a proximity of a second rifle scope based on the signal. In an embodiment, the controller provides a visual indicator to a display of the rifle scope indicating the proximity of the second rifle scope.

In another embodiment, a method includes transmitting a first signal using a transmitter of a rifle scope. The first signal includes first location data corresponding to a physical location of the rifle scope. The method further includes receiving a second signal using a receiver of the rifle scope. The second signal includes second location data corresponding to a physical location of a second rifle scope. Additionally, the method includes determining a proximity of the second rifle scope relative to the first rifle scope based on the first and second location data. In an embodiment, the controller provides a visual indicator to a display of the rifle scope indicating the proximity of the second rifle scope.

In still another embodiment, an apparatus includes a radio frequency receiver configured to receive a signal including location data corresponding to a physical location of a rifle scope and includes a display. The apparatus further includes a controller coupled to the radio frequency receiver and the display. The controller is configured to determine a relative proximity of the rifle scope based on the location data and to provide a visual indicator corresponding to the relative proximity to the display.

BRIEF DESCRIPTION OF THE DRAWINGS

In the following discussion, the same reference numbers are used in the various embodiments to indicate the same or similar elements.

DETAILED DESCRIPTION OF ILLUSTRATIVE EMBODIMENTS

Embodiments of a system, method, and apparatus are described below that are configured to provide proximity detection. In an embodiment, an optical device, such as a rifle scope, receives a wireless signal and detects a proximity of another rifle scope in response to receiving the wireless signal. The wireless signal may be received from a proximity detection system through a communications network or from the other rifle scope through the communications network or through an ad hoc communications link. In the following discussion a rifle scope is described; however, it should be appreciated that other devices may be configured to determine a proximity of a rifle scope. Such devices may include binoculars, spotting scopes, smart phones, or other computing devices. Further, it should be appreciated that the optical device may detect the proximity of any number of other hunters based on reception of wireless signals from those other devices. For simplicity, the following discussion describes proximity detection within a rifle scope. An example of a method detecting proximity of another rifle scope is described below with respect to FIG. 1.

Figure 1:
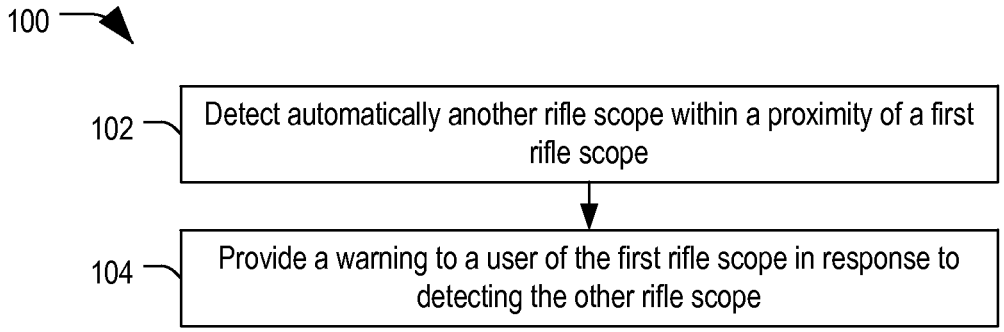
FIG. 1 is a flow diagram of an embodiment of a method of detecting a proximity using a rifle scope.

FIG. 1 is a flow diagram of an embodiment of a method 100 of detecting a proximity using a rifle scope. At 102, a controller or processor of a first rifle scope automatically detects another rifle scope within a proximity of the first rifle scope. In an embodiment, the first rifle scope and the second rifle scope may be made and/or sold by the same company, such as TrackingPoint, Inc. of Austin, Tex., which is the assignee of the present disclosure. In this example, both of the rifle scopes include a transmitter or transponder configured to send a signal that can be used by the other rifle scope to determine the proximity. In an example, the signal may include GPS coordinates or other location data that can be used to determine the proximity.

Advancing to 104, the controller or processor of the first rifle scope provides a warning to a user in response to detecting the other rifle scope. In an example, the warning may be a visual alert provided to a display of the first rifle scope. In another embodiment, the warning may include an audio alert in addition to or in lieu of the visual alert. In an embodiment, the controller may determine proximity of multiple other rifle scopes and may present multiple visual or audio alerts indicating their relative proximity.

In an embodiment, a digital rifle scope includes a display configured to provide images of the view area, which display can be used to present the visual alert. One possible example of a visual alert corresponding to detection of the proximity of another rifle scope is described below with respect to FIG. 2.

Figure 2:
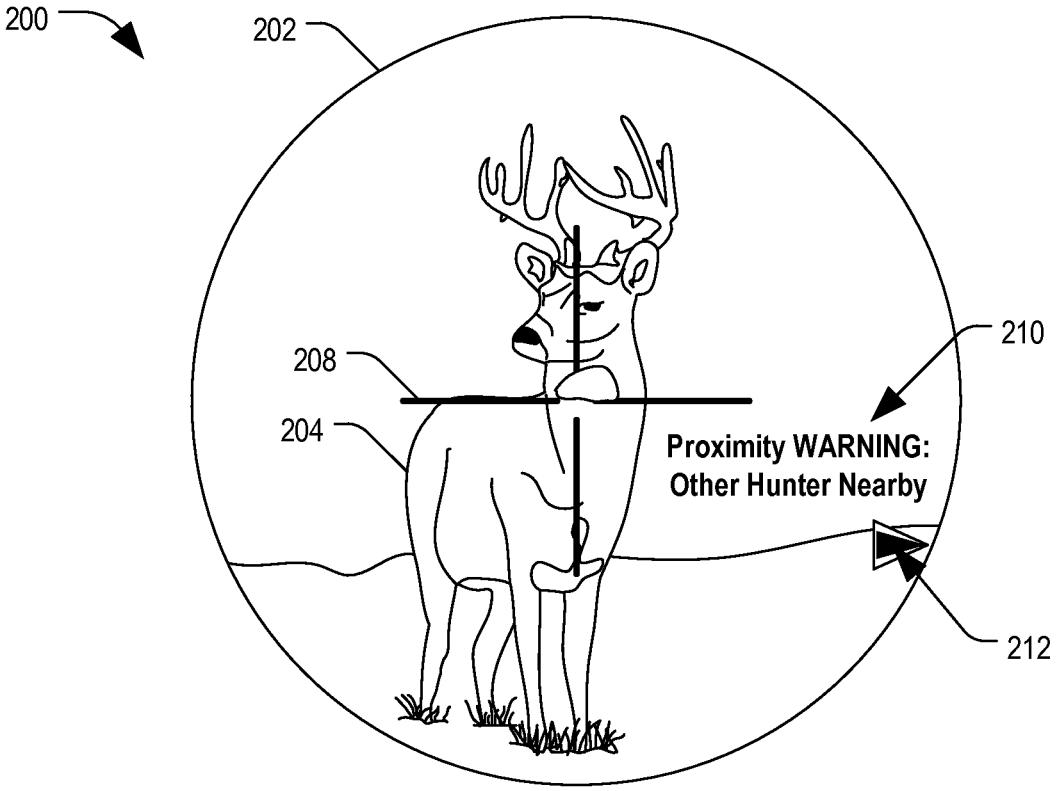
FIG. 2 is a diagram of a representative example of a display of an optical device, such as a rifle scope, presenting a portion of a view area and a proximity warning.

FIG. 2 is a diagram of a representative example of a display 200 of an optical device, such as a rifle scope, presenting a portion of a view area 202 and a proximity warning 210. View area 202 includes a potential target 204.

In this example, potential target 204 is a deer, and the controller or processor of the rifle scope presents a digital reticle 208 that is centered within the portion of the view area 202.

Proximity warning 210 represents a visual cue or indicator. In this example, proximity warning 210 includes text and a directional indicator 212 that points in a direction corresponding to the location of the other rifle scope relative to the digital rifle scope. In this example, directional indicator 212 points toward the right outside of view area 202. As the user changes the orientation of the rifle scope, such as by shifting the aim point of the rifle scope to the right, a visual parameter of directional indicator 212 and/or proximity warning 210 may change.

In a particular example, the warning may change based on the orientation of the rifle scope relative to the other rifle scope. In an example, orientation sensors within the first rifle scope may be used to determine an aim point of the first rifle scope relative to a location of the other rifle scope. In one embodiment, the controller may cause a visual parameter such as the color or size of a visual indicator to change as the aim point approaches the location of the other rifle scope. In another embodiment, the audio alert may change in tone, frequency, volume or some other audible parameter or in content in response to changes in the proximity. Thus, the first rifle scope provides a warning to a user of the proximity of another hunter.

Figure 3:
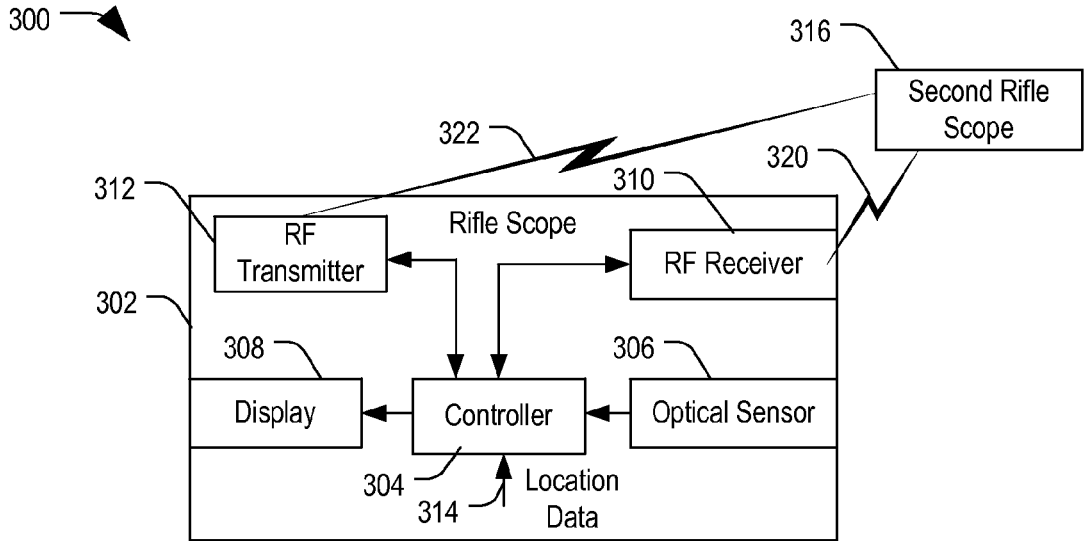
FIG. 3 is a block diagram of a system including a rifle scope configured to provide proximity detection.

FIG. 3 is a block diagram of a system 300 including a rifle scope 302 configured to provide proximity detection. Rifle scope 302 includes a controller 304 coupled to an optical sensor 306 configured to capture video data of a view area. The controller 304 is also coupled to a display 308 to provide at least a portion of the video data. Controller 304 is further coupled to a radio frequency (RF) receiver 310 to receive a signal 320 and to an RF transmitter 312 to send a signal 322.

In an example, signal 320 includes location data corresponding to a physical location of another rifle scope. The location data may include global positioning satellite (GPS) coordinates. Controller 304 may receive location data 314 corresponding to its own physical location and may compare location data 314 to the location data (such as GPS coordinates) received from signal 320 to determine a proximity of rifle scope 302 to a second rifle scope 316. In an embodiment, location data 314 may be received from another electronic device in close proximity to rifle scope 302. In another embodiment, location data 314 is derived internally, for example, from a GPS circuit as described below with respect to FIG. 4.

Figure 4:
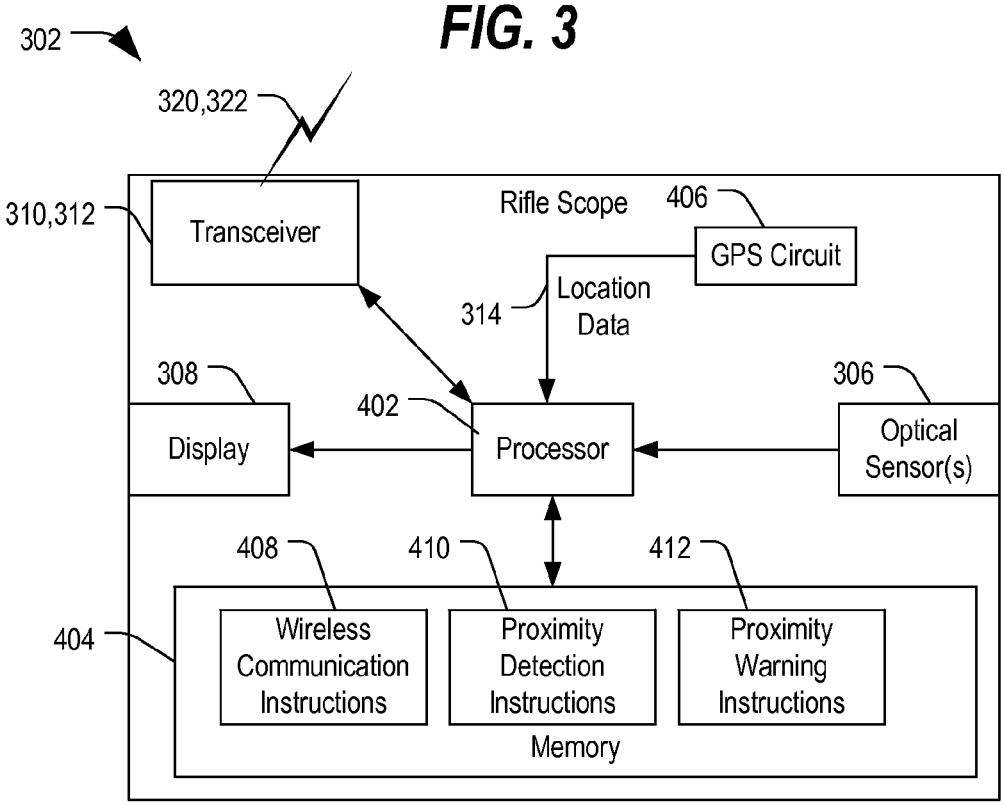
FIG. 4 is a block diagram of a second embodiment of the rifle scope of FIG. 3 including a global positioning satellite (GPS) circuit.

FIG. 4 is a block diagram of a second embodiment of the rifle scope 302 of FIG. 3 including a global positioning satellite (GPS) circuit 406. In the illustrated example, RF receiver 310 and RF transmitter 312 are combined into a single block labeled "Transceiver" 310 and 312, which is coupled to a controller that is implemented as a processor 402 coupled to a memory 404. Processor 402 is also coupled to optical sensors 306 and display 308 and to GPS circuit 406.

Memory 404 stores wireless communication instructions 408 that, when executed by processor 402, causes processor to receive signal 320 from second rifle scope 316 and to send signal 322, which may be received by second rifle scope 316 and optionally by other wireless transceivers in the wireless signal range of rifle scope 302. Signals 320 and 322 may include location data, such as GPS coordinate data. In an example, signal 320 may include GPS coordinate data corresponding to a physical location of second rifle scope 316, and rifle scope 302 may send its own GPS coordinate data within transmitted signal 322 so that other scopes or devices may utilize the location data to determine proximity information.

Memory 404 further includes proximity detection instructions 410 that, when executed, cause processor 402 to determine a proximity of second rifle scope 316 relative to rifle scope 302 by comparing location data 314 from GPS circuit 406 to location data from signal 320. Memory 404 further includes proximity warning instructions 412 that, when executed, cause processor 402 to provide a visual indicator or visual cue to display 308. The visual indicator or visual cue may include text and/or a directional indicator, such as an arrow or pointer. Further, proximity warning instructions 412 may cause processor 402 to alter a visual parameter of the visual indicator or visual cue as the relative proximity changes. The visual parameter may be a size, shape, or color, for example. Further, altering the visual parameter may include flashing the visual indicator or cue as second rifle scope 316 approaches rifle scope 302. In one possible non-limiting embodiment, rifle scope 302 may include orientation sensors that provide orientation data to processor 402, making it possible for processor 402 to determine if an aim point of rifle scope 302 is toward the location of the second rifle scope 316 and may also alter the visual parameter as the aim point of rifle scope 302 moves toward or away from a position of rifle scope 316, indicating danger as the aim point moves toward the position and indicating relatively safer conditions when the aim point moves way from the position of second rifle scope 316.

In an alternative embodiment, rifle scope 302 may include a speaker (not shown) to produce sound that can be heard by the user. In this example, memory 404 stores instructions that, when executed, cause processor 402 to produce an audio signal for reproduction by the speaker. The audio signal may be used to provide an audible indicator indicating the proximity of second rifle scope 316. The audible indicator may change in tone, frequency, volume or some other audible parameter or in content in response to changes in the proximity.

While the embodiment of FIG. 4 includes a GPS circuit 406 to provide location data 314, it is also possible to receive location data through a communication channel from an external device, such as a hand-held GPS unit, a smart phone, a portable computing device, or some other electronic device. The communication channel may be wired or wireless, depending on the implementation. One possible embodiment of a system to provide proximity detection using location data from an external device is described below with respect to FIG. 5.

Figure 5:
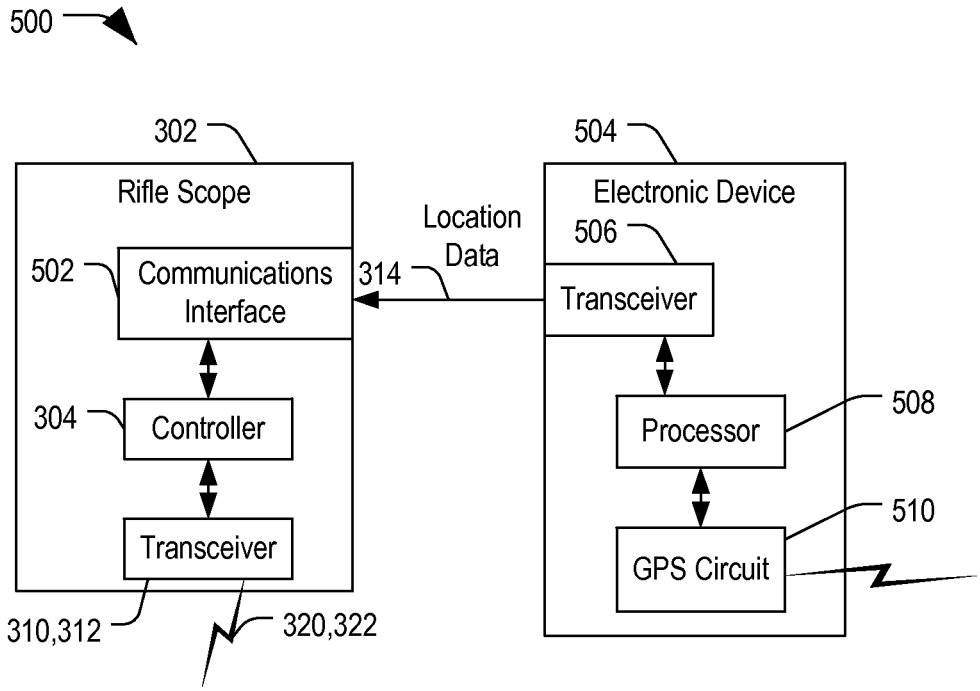
FIG. 5 is a block diagram of a system including a third embodiment of the rifle scope of FIG. 3 configured to couple to an electronic device that includes a GPS circuit.

FIG. 5 is a block diagram of a system 500 including a third embodiment of the rifle scope 302 of FIG. 3 configured to couple to an electronic device 504 that includes a GPS circuit 510. In the illustrated example, rifle scope 302 includes all of the elements of rifle scope 302 in FIG. 3 and further includes a communications interface 502 coupled to controller 304 and that is configured to communicate with electronic device 504 though a communications channel to receive location data 314. In an embodiment, communications interface 502 may include a short-range wireless interface, such as a Bluetooth® transceiver. In another embodiment, communications interface 502 may include a wired interface, such as a universal serial bus (USB) port and associated circuitry. In still another embodiment, communications interface 502 may include both wired and wireless interfaces.

Electronic device 504 may be a portable GPS device, a smart phone, a portable computer, or another electronic device that is configured with GPS circuit 510 and a transmitter, such as transceiver 506, which is configured to send location data 314 to communications interface 502 of rifle scope 302 through the communications channel GPS circuit 510 is coupled to a processor 508, which is coupled to transceiver 506. In an example, processor 508 may be a general purpose processor or may be network interface circuit or other data processing circuit configured to package the location data into a suitable format for transmission by transceiver 506 to rifle scope 302.

In an example, electronic device 504 may utilize GPS circuit 510 to determine GPS coordinates corresponding to a physical location of electronic device 504. The GPS coordinates may then be processed by processor 508 into a data packet or other transmission format (such as an Ethernet frame, a Bluetooth® data format, or some other format) for transmission via transceiver 506 to rifle scope 302. In response to receiving the location data, rifle scope 302 may transmit the location data corresponding to the position of the electronic device 504 as part of signal 322. Such data may be used by a second rifle scope (such as rifle scope 316 in FIG. 3), which can determine the proximity of rifle scope 302.

Additionally, in response to receiving the location data, rifle scope 302 may compare the location data to GPS coordinates (or second location data) received from signal 320 that was transmitted by another device, such as second rifle scope 316. Rifle scope 302 may determine a proximity of second rifle scope 316 based on the comparison and may provide a visual indicator representing the proximity to display 308.

In the above examples, rifle scope 302 and rifle scope 316 may be made by the same manufacturer and may be configured to communicate using a standard protocol or using a proprietary protocol, depending on the implementation. In some embodiments, two rifle scopes may be proximate to one another and may be unable to communicate their location data through short-range wireless interface. In one example, a communications channel may be lost or broken due to the presence of intervening structures or geophysical features. In another example, the two devices may detect signals from one another, but may be unable to establish a communications link (for example, because they are using proprietary protocols). In such examples, rifle scopes may selectively attempt to communicate through a larger communications network. One possible example of a rifle scope configured for multi-path communication is described below with respect to FIG. 6.

Figure 6:
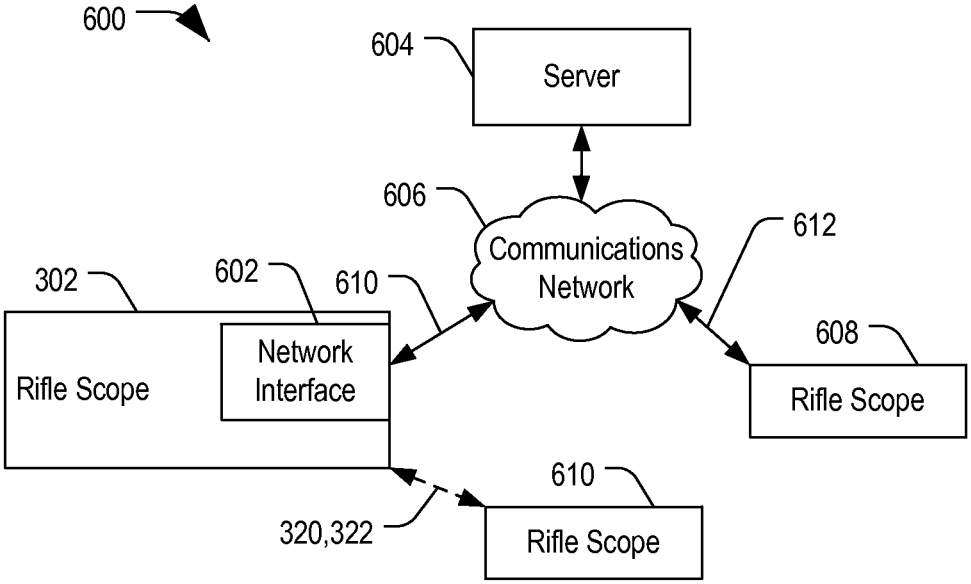
FIG. 6 is a block diagram of a system including an embodiment of the rifle scope of FIG. 3 including a network interface and configured to communicate with other rifle scopes directly or through a network to provide proximity detection.

FIG. 6 is a block diagram of a system 600 including an embodiment of the rifle scope 302 of FIG. 3 including a network interface 602 and configured to communicate with other rifle scopes 608 and 610 directly or through a network 606 to provide proximity detection. Rifle scope 302 includes the features of rifle scope 302 in FIG. 3, 4, or 5 and also includes network interface 602 configured to establish a communications link to a communications network, such as a wireless communication network. In this example, rifle scope 302 may communicate through a short range wireless communications link with rifle scope 610 through signals 320 and 322. However, rifle scope 302 may also utilize network interface 602 to communicate location data to communications network 606.

Rifle scope 608 may include a network interface to communication with communications network 606. In one possible embodiment, a server 604 may be configured to receive the location data from signal 310 and location data from rifle scope 608 and to share such location data by pushing or transmitting location data associated with one or more devices to rifle scope 302 when the one or more devices are close to the physical location of rifle scope 302. In this example, server 604 may be a hunting server corresponding to a game and wildlife department of a state government or may be a third-party proximity warning system server that monitors location data to provide proximity data to rifle scopes (either in response to a query or automatically based on their reported location data) to facilitate proximity detection.

In an embodiment, initial communications between rifle scope 608 and 302 may occur through a short-range wireless signal, such as signals 320 and 322. Through these signals, in addition to proximity data, a communications identifier (such as a phone number, a text message address, or other communication identifier) may be shared so that, if the short-range link is disrupted or lost, rifle scope 302 and 608 may reestablish communication to continue to share location data through communication network 606.

It is to be understood that, even though characteristics and advantages of the various embodiments have been set forth above, together with details of the structure and function of various embodiments, changes may be made in details, especially in the matters of structure and arrangement of parts within principles of the present disclosure to the full extent indicated by the broad meaning of the terms in which the appended claims are expressed. For example, while the description of the embodiments has focused on a rifle scope implementation in which the rifle scope 302 receives the location data from a second rifle scope 316, it is also possible to receive the location data for a rifle scope at an electronic device or apparatus, such as a smart phone executing a proximity detection application, a computing device executing a proximity detection application, or some other electronic apparatus configured to provide proximity detection. Further, it is also possible to detect proximity of multiple other devices. In this example, a short-range transceiver may be used to communicate location data for the apparatus and to receive location data associated with the rifle scope so that the apparatus can provide a warning, for example, to a hiker that there are hunters in the area (and vice versa). Further, the particular components or elements may vary depending on the particular implementation of the proximity detection device while maintaining substantially the same functionality without departing from the scope and spirit of the disclosure. In addition, while the above-discussion focused on providing a visual indicator or visual cue, it will be appreciated by those skilled in the art that the teachings disclosed herein can be carried out using other detectable warnings, such as vibration, audible warnings, and so on. Just as with the visual cue, a parameter of the warning may vary in frequency and/or intensity based on changes in the relative proximity.

Although the present invention has been described with reference to preferred embodiments, workers skilled in the art will recognize that changes may be made in form and detail without departing from the scope of the invention.

What is claimed is:

1. A rifle scope comprising:

an optical sensor configured to capture video data of a view area;

a display;

a transceiver configured to send a signal including location data associated with the rifle scope and to receive a signal including location data corresponding to a physical location of a second rifle scope; and a controller coupled to the optical sensor, the transceiver and the display, the controller configured to provide at least a portion of the video data to the display, the controller configured to determine a proximity of the second rifle scope based on the signal and to provide a visual cue to the display that corresponds to the physical location of the second rifle scope within the portion of the video data and that indicates the proximity, the controller configured to determine an aim point of a firearm determined from an orientation of the rifle scope relative to the view area and to selectively change at least one of a color parameter and a size parameter of the visual cue when the aim point approaches or moves away from the physical location of the second rifle scope.

2. The rifle scope of claim 1, further comprising a transmitter coupled to the controller and configured to send a radio frequency signal including location data corresponding to a physical location of the rifle scope.

3. The rifle scope of claim 2, further comprising a communications interface coupled to the controller and configured to communicate with an electronic device to receive the location data, the electronic device including at least one of a smart phone, a computing device, and a global positioning satellite (GPS) device.

4. The rifle scope of claim 3, wherein the communications interface is configured to communicate with the electronic device through a wireless communication channel.

5. The rifle scope of claim 2, further comprising a global positioning satellite (GPS) circuit coupled to the controller and configured to provide the location data to the controller.

6. The rifle scope of claim 1, wherein the signal includes global positioning satellite (GPS) coordinates associated with the second rifle scope.

7. The rifle scope of claim 1, wherein the controller selectively alters at least one of the color parameter and the size parameter when the proximity of the second rifle scope changes.

8. A method comprising:

capturing video data of a view area via a sensor of a rifle scope;

transmitting a first signal using a transmitter of the rifle scope, the first signal including first location data corresponding to a physical location of the rifle scope;

receiving a second signal using a receiver of the rifle scope, the second signal including second location data corresponding to a physical location of a second rifle scope;

determining, at a controller of the rifle scope, a proximity of the second rifle scope relative to the first rifle scope based on the first and second location data;

providing at least a portion of the video data to a display of the rifle scope; and providing a visual indicator corresponding to the physical location of the second rifle scope within the portion of the video data and an alert to one of the display and a speaker, the controller coupled to the display and the speaker and configured to selectively alter an intensity of the alert based on an aim point of the rifle scope relative to the physical location of the second rifle scope.

9. The method of claim 8, wherein providing the alert to the display comprises providing a visual cue representing the proximity to the display of the rifle scope, the visual cue representing the proximity of the second rifle scope by at least one of a color parameter and a size parameter.

10. The method of claim 9, further comprising selectively altering at least one of the color parameter and the size parameter of the visual cue when the proximity changes.

11. The method of claim 8, further comprising receiving the first location data from an external device through a communications interface.

12. The method of claim 11, wherein the communications interface includes a short-range wireless transceiver configured to communicate wirelessly with the external device.

13. The method of claim 8, further comprising receiving the first location data from a global positioning satellite circuit of the rifle scope.

14. The method of claim 8, wherein providing the alert to the speaker comprises providing an audible signal representing the proximity to the speaker, the audio alert representing the proximity of the second rifle scope by at least one of a volume parameter and a frequency parameter.

15. The method of claim 14, further comprising selectively altering at least one of the volume parameter and the frequency parameter of the audible signal when the proximity changes.

16. An apparatus comprising:

a radio frequency receiver configured to receive a signal including location data corresponding to a physical location of a rifle scope;

a display; and a controller coupled to the radio frequency receiver and the display, the controller configured to determine a proximity of the rifle scope relative to the apparatus based on the location data and to provide a visual indicator representing the physical location and the proximity to the display, the visual indicator including at least one of a color parameter and a size parameter indicative of the proximity, the controller configured to change one of the color parameter and the size parameter associated with the visual indicator when a aim point of the apparatus changes relative to the physical location of the rifle scope.

17. The apparatus of claim 16, wherein the apparatus comprises at least one of a rifle scope, a spotting scope, a pair of binoculars, a smart phone, and a computing device.

18. The apparatus of claim 16, wherein the visual indicator includes at least one of a text alert and a directional indicator configured to point in a direction of the rifle scope.

19. The apparatus of claim 16, further comprising:

a global positioning satellite (GPS) circuit coupled to the controller and configured to provide GPS coordinates to the controller; and wherein the controller determines the proximity of the rifle scope by comparing the location data to the GPS coordinates.

20. The apparatus of claim 16, further comprising a communications interface coupled to the controller and configured to receive global positioning satellite coordinates from an electronic device.

21. The apparatus of claim 16, further comprising a radio frequency transmitter configured to transmit a second signal including second location data corresponding to a physical location of the apparatus.

22. The apparatus of claim 16, wherein the controller varies at least one of the color parameter and the size parameter in response to changes in the proximity of the rifle scope relative to the apparatus.

* * * * *